US006201224B1

(12) United States Patent
Churchland et al.

(10) Patent No.: US 6,201,224 B1
(45) Date of Patent: Mar. 13, 2001

(54) METHOD OF MAKING A COMPOSITE WOOD PRODUCT FROM WOOD ELEMENTS

(75) Inventors: Mark Trelawny Churchland; Robert Leeson Pike, both of Vancouver; Norbert Kott, Fort Langley, all of (CA)

(73) Assignee: Trus Joist MacMillan Limited, Vancouver (CA)

( * ) Notice: Subject to any disclaimer, the term of this patent is extended or adjusted under 35 U.S.C. 154(b) by 7 days.

(21) Appl. No.: 09/609,969

(22) Filed: Jul. 3, 2000

(51) Int. Cl.[7] ..... H05B 6/78; B27N 3/18

(52) U.S. Cl. ..... 219/678; 219/698; 219/700; 156/272.2; 156/273.7; 156/275.5; 264/405; 264/490

(58) Field of Search ..... 219/678, 679, 219/695, 698, 700, 701; 156/272.2, 273.7, 275.5, 275.7; 34/259, 264; 264/405, 420, 425, 489, 490

(56) References Cited

U.S. PATENT DOCUMENTS

| | | | |
|---|---|---|---|
| 3,880,975 | 4/1975 | Lundmark | 264/119 |
| 4,018,642 | 4/1977 | Pike et al. | 156/272.2 |
| 4,216,179 | 8/1980 | Lamberts et al. | 264/119 |
| 4,293,509 | 10/1981 | Bücking | 264/26 |
| 4,456,498 | 6/1984 | Churchland | 219/699 |
| 5,063,010 | 11/1991 | Fischer et al. | 264/109 |
| 5,756,975 * | 5/1998 | Harris et al. | 219/696 |
| 5,892,208 | 4/1999 | Harris et al. | 219/696 |

FOREIGN PATENT DOCUMENTS

| | | |
|---|---|---|
| 197 18 772 * | 11/1998 | (DE) . |
| WO 92/01540 * | 2/1992 | (WO) . |

* cited by examiner

*Primary Examiner*—Philip H. Leung
(74) *Attorney, Agent, or Firm*—C. A. Rowley

(57) ABSTRACT

A method of producing a consolidated composite wood product composed of discrete wood elements and a binder by forming a layup and preheating only a central longitudinal portion of the layup by application of microwave energy across the longitudinal axis and then pressing to consolidate the layup and applying further microwave energy in a direction perpendicular to the direction of the application of the preheating microwave energy through the sides of the compressed layup in the press.

12 Claims, 4 Drawing Sheets

METHOD OF MAKING A COMPOSITE WOOD PRODUCT FROM WOOD ELEMENTS

FIELD OF INVENTION

The present invention relates to a method of making a composite wood product from wood elements, more particularly the present invention relates to an improved method of heating composite wood layups to improve the uniformity of the consolidated composite wood product being produced.

BACKGROUND OF THE INVENTION

There are many teachings and commercial applications relating to the production of consolidated composite wood products where a layup of discrete wood elements coated with an appropriate adhesive is consolidated by application of heat and pressure to bind the discrete wood elements together and thereby form a consolidated composite wood product. Sufficient heat is applied to heat the adhesive to a temperature sufficient to cure the adhesive (thermo-setting resin such as phenol formaldehyde, and the like).

U.S. Pat. No. 3,880,975 issued Apr. 29, 1975 to Lundmark describes the process of making a resin bonded hardboard by uniformly across the width of the layup, heating and compressing the layup to reduce its thickness slightly by a pair of heated nip forming rolls, then finally compressing and setting the resin in a hot plate press. This system is for the production of hardboard which generally employs very small wood particles and the prepressing stage is simply a minor precompression and heating stage wherein the pressing rollers are heated to transfer some heat at least to the surface of the layup being processed.

U.S. Pat. No. 4,216,179 issued Aug. 5, 1980 to Lamberts et al. discloses a system for making particleboard from wood particles in the form of chips or fibers or the like and wherein a high frequency preheating device directs high frequency energy into the layup uniformly across its width to preheat the layup preferably using a plurality of high frequency heating units in series. The patent described heating the mat adjacent to its middle to between 50 and 70° C. or higher. The so preheated layup is subsequently pressed in a further press (unheated) and then a finishing press completes the consolidation by pressing under elevated temperature and pressure conditions.

U.S. Pat. No. 4,293,509 issued Oct. 6, 1981 to Bucking is similar to the above-described Lamberts et al patent in that it applies high frequency preheating. The concept of this patent is to apply high frequency preheating to heat the layup from the inside and cause the flow of steam out of the layup. The layup after the preheating stage maybe prepressed then it is finally pressed at elevated temperature by a steam press wherein the steam from the press penetrates the layup. Again, in all cases, the heating is as uniform as possible over the full width of the layup.

U.S. Pat. No. 5,063,010 issued Nov. 5, 1991 to Fisher et al. describes yet another system of forming a fiber or chipboard and conditions the mat by applying steam in a preheating section to raise the temperature and moisture content of the mat and the so conditioned mat is subsequently heated and compressed to the consolidated end product (fiber or chipboard).

The use of microwave energy to heat a layup is disclosed in U.S. Pat. No. 4,018,642 issued Apr. 19, 1997 to Pike et al. In this system, microwave energy is used to cure the resin in a very short period of time compared to conventional hot presses while avoiding the arcing and tracking problems that are involved with radio frequency heating. The microwave energy is applied either at the time of pressing or slightly before.

U.S. Pat. No. 4,456,498 issued Jun. 26, 1984 to Churchland describes a microwave heating system where the microwaves are introduced between a pair of pressure applying belts and travel across the width of the layup being compressed by the belts to heat the layup and cure the resin. This system has been commercially employed to manufacture a product sold by Trus Joist Macfillan, a Limited Partnership, under the trademark Parallan®. This patent discloses the particular type of pressing system for which the present invention is a significant improvement.

U.S. Pat. No. 5,892,208 issued Apr. 6, 1999 to Harris et al. discloses a system for heating a layup using circular magnetic mode microwave energy to uniformly heat the layup across substantially its full width.

The application of microwave energy between press belt as shown for example, in U.S. Pat. No. 4,456,498 of Churchland, applies the microwave energy from a pair of opposite side faces of the layup being pressed while the layup is under pressure, thus the microwave power is applied through supporting windows and penetrates into the layup from opposite sides. These systems generally heat the layup to a greater degree adjacent to the windows than the axial center of the layup so that if care is not taken uniformity of the product may be affected. Uniformity is also sometimes affected by local over heating of the layup to generate steam in pockets that tend to blow, disrupting the surface of the consolidated end product.

BRIEF DESCRIPTION OF THE PRESENT INVENTION

It is an object of the present invention to consolidate a composite wood product by preheating and then heating under compression to complete consolidation thereby to more uniformly distribute the heat through the product and improve product uniformity.

Broadly, the present invention relates to a method of producing a consolidated composite wood product composed of wood elements and a binder having a setting temperature comprising forming a layup for such wood elements and binder, said layup having a width W measured substantially perpendicular to a longitudinal axis of said layup and a thickness $t_1$, moving said layup in a direction parallel to said longitudinal axis, applying a preheating microwave energy through the thickness of said layup applying at least 90% of said microwave energy in a manner to heat a central portion of said layup, said central portion having a width $W_C$ no greater than 80% of the width W of the layup and spaced from an entrance end of a consolidating press by a distance D sufficient to permit moisture heated by said microwave energy to distribute in said layup, reducing the thickness of said layup to a final thickness $t_2$ in said press and applying microwave energy to set said binder in said layup in said press by directing microwave energy to pass through said layup in a direction substantially perpendicular to the direction of the application of said preheating microwave energy in said preheating stage to heat said layup to a temperature above said setting temperature of said binder whereby said binder sets after said layup has been pressed to its final thickness $t_2$ thereby to form said consolidated wood product.

Preferably, the highest temperature to which said layup is heated by said application of said preheating microwave energy is less than said setting temperature of said binder.

Preferably, said microwave energy applied in said preheating station is in the $TE_{10}$ mode with the electric field vector being applied to said layup along its longitudinal axis.

Preferably, said microwave energy applied in said preheating station is in the $TE_{10}$ rectangular mode.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
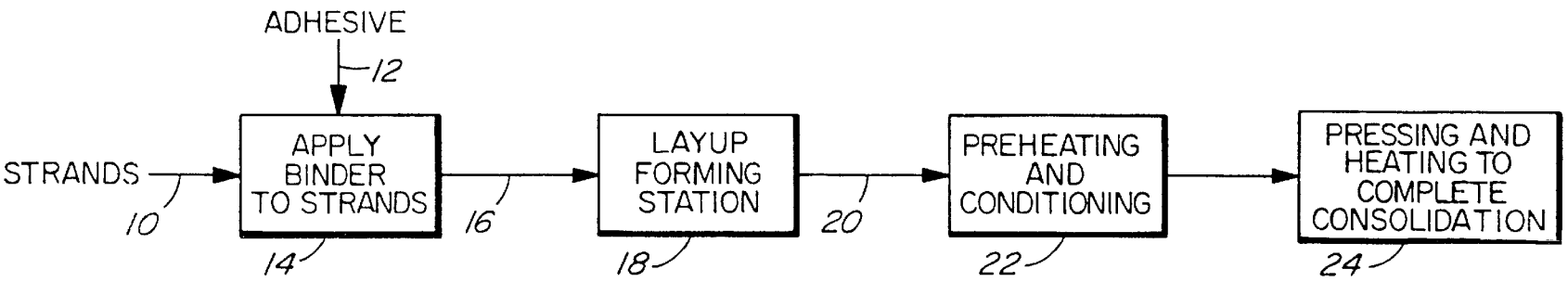
FIG. 1 is a schematic illustration of the most important steps of the present invention.

FIG. 1 shows schematically the main steps in carrying out the present invention as illustrated. Wood elements (including strands, wafers, particles, fibers and/or layers of veneer and the like) are introduced as indicated by the arrow 10 and the adhesive as indicated by arrow 12 into the adhesive applying station 14 where the wood elements are coated as required by a suitable binder or adhesive which generally will be phenol formaldehyde resin although other adhesives may be used such as issocyanates or the like, i.e. suitable thermal setting resin type adhesives.

The coated element then passed as indicated by the arrow 16 into a layup forming station 18 where the elements are formed into a layup. Preferably, the layup forming station 18 will lay the elements in substantially parallel relationship (i.e. with their longitudinal axes substantially parallel) to form an oriented strand board or a parallel strand lumber product.

In the preferred embodiment in the present invention, the elements are very long having lengths up to eight feet measured in the longitudinal direction and widths in the order of less than about an inch and thickness' less than about a quarter inch although other elements such as those conventionally used for the manufacture of oriented strand board (OSB) or long wafer type material where the elements are in the order of a foot long may also be used.

The layup formed at 18 is continuously advanced as a continuous layup as indicated by the arrow 20 into a preheat and conditioning station 22 wherein microwave energy on a selected frequency preferably 915 MHz is applied from the top and from the bottom of the layup 20 over a central portion only of the layup as will be discussed below to preheat substantially only a central portion of the layup (widthwise).

Figure 2:
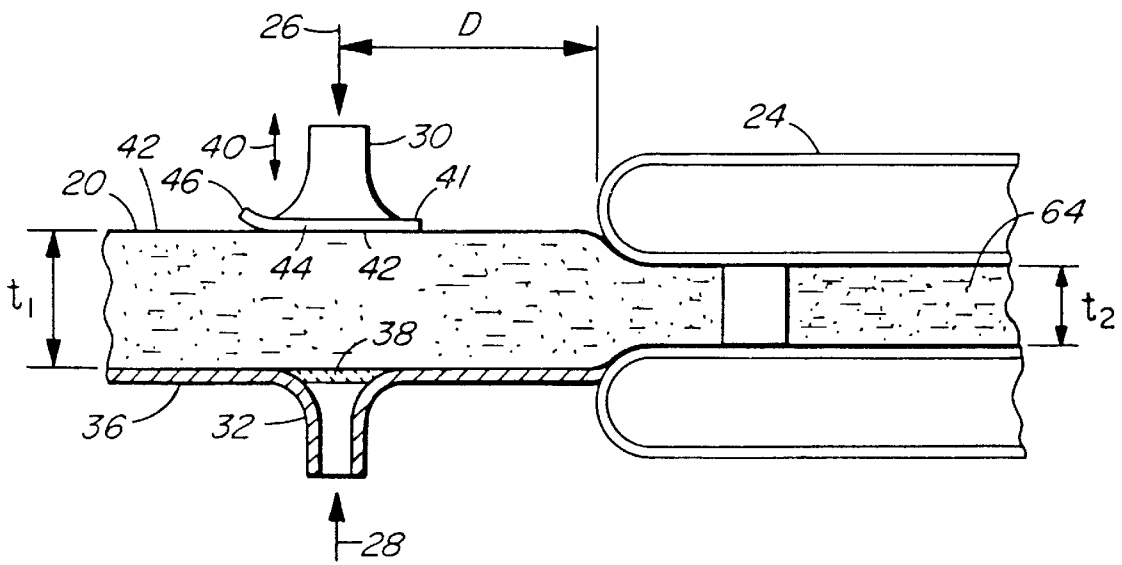
FIG. 2 is a schematic side elevation illustrating the process of the present invention.

The process of the present invention will become more apparent from FIG. 2 and and the description thereof The layup 20 is formed into a mat having a first thickness $t_1$ and passes into the preheating section 22 wherein microwave energy as represented by the arrows 26 and 28 are applied via an upper wave guide 30 and a lower wave guide 32 respectively. The layup 20 as it passes from a layup forming station 18 to the press section 24 is preferably contained within a trough schematically indicated at 34 that supports the bottom and two opposed sides of the layup or mat 20 with the top of the layup being open.

In the illustrated arrangement, the wave guide or horn of the wave guide 32 passes up through the bottom 36 of the trough 34 and through a window 38 opening from the wave guide 32 or horn 32 and forming a part of the bottom 36 of the trough 34 supporting the mat 20.

The upper wave guide or horn of the wave guide 30 is positioned in floating relationship as represented by the arrow 40 on a shoe 41 having an upwardly curved intake plow 46. The shoe 41 rests on the top 42 of the layup 20 with sufficient weight to compress the layup slightly from the thickness $t_1$ thereby ensuring good contact between the floating wave guide 30 and the layup or mat 20 i.e. the weight of the upper wave guide 30 and shoe 41 are counterbalanced in any suitable way to control the pressure applied to the top 42 of the layup or mat 20.

Figure 3:
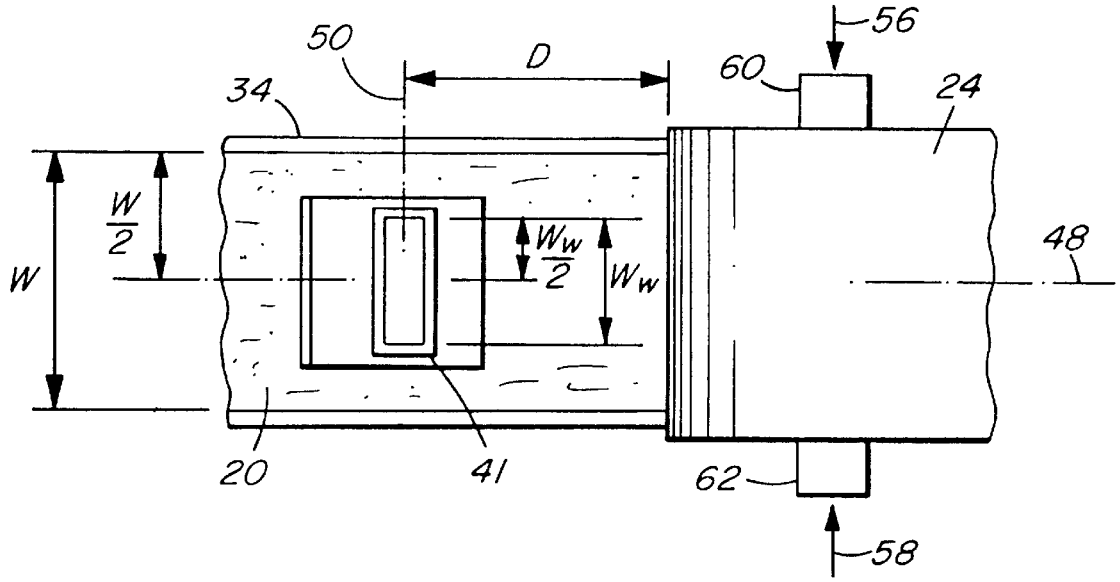
FIG. 3 is a plan view illustrating the process of the present invention and the relative positions of the preheater and press.
Figure 4:
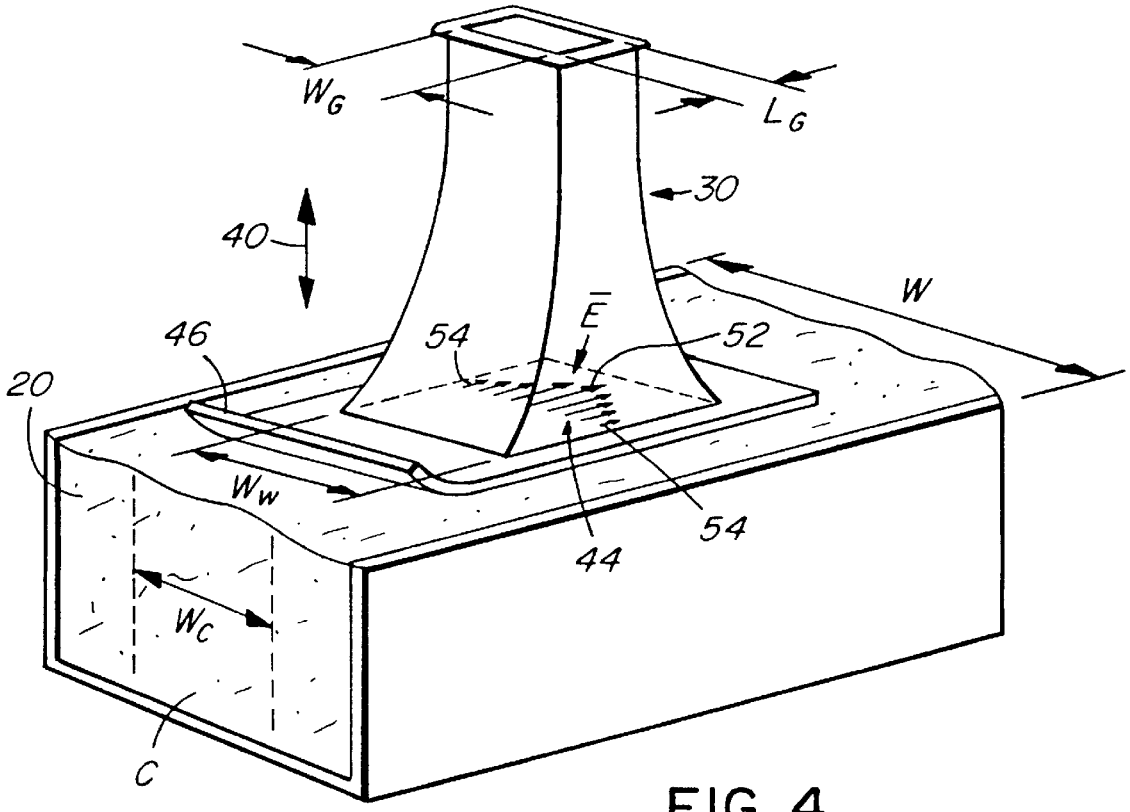
FIG. 4 is an isometric schematic illustration of the preheating station illustrating the configuration of the electrical vectors of microwave energy being applied to the mat or layup.

The horn 30 which is essentially the same as the horn 32 except that the horn 32 is not floating is shown in more detail in FIG. 4. As shown in this Figure and in FIG. 3, the layup has a width W and the window 44 (and 38) has a width $W_W$ which heats effectively less than 80% of the width W of the layup (which is determined by the width of the trough 34). The trailing end of the shoe 41 surrounding the widow 44 of the horn 30 and aiding in positioning the window 44 adjacent to the surface 42 of the mat 20 is as above described provided with a curved up plow 46 to ensure that the mat 20 slides under the wave guide 30 and facilitates the floating of the wave guide or the horn 30 on the surface 42 of the mat 20 and maintaining contact between the window 44 and the top surface 42 of the layup 20.

The wave guide leading into the horn 30 is preferably rectangular in cross section and has a width $W_G$ and a length measured in the direction of movement equal to $L_G$. Generally, the width $W_G$ is equal to the width $W_W$ and the length $L_G$ will be in the order of one half $W_G$ i.e. to generate a $TE_{10}$ rectangular mode.

As shown in FIG. 3, the axial center line 48 of the trough 34 and of the press forming the press section 24 extends along the id-line of the trough 34 and thus, the layup 20 and similarly of the wave guides 30 and 32 so that the width of the windows 38 and 44 on opposite sides of the centerline 48 are equal, i.e. the wave guides 30 and 32 particularly the windows 38 and 44 are symmetrical to the centerline 48.

The transverse centerline of the wave guides 32 and 30 which in the illustrated arrangement are superimposed one directly above the other as represented by the line 50 in FIG. 3 and the arrows 26 and 28 is spaced from the front or adjacent end of the press section 24 by a distance D. This distance D is preferably set to be sufficient to allow time as the layup 20 travels from the preheating and conditioning section 22 into the press 24 for the preheat applied in the preheating section 22 to continue conditioning of the layup 20 by causing moisture to migrate from the wettest sections of the layup.

Turning again to FIG. 4, the microwave energy is shown applied to the wave guide or horn 30 and similarly to the wave guide or horn 32 in the $TE_{10}$ mode preferably as above indicated the $TE_{10}$ rectangular mode which forms a sinusoidal pattern so that electrical vectors of the energy are maximum along the axial centerline (in the direction of movement of the layup 20, i.e. the line 48 shown in FIG. 3) and minimum adjacent to the side edges of the window 44, see vectors 52 and 54 in FIG. 4. This configuration and orientation of the energy vectors E results in the maximum amount of heat or energy being applied along the axial centerline 48 and reducing towards the sides of the windows 44 and 38.

Figure 6:
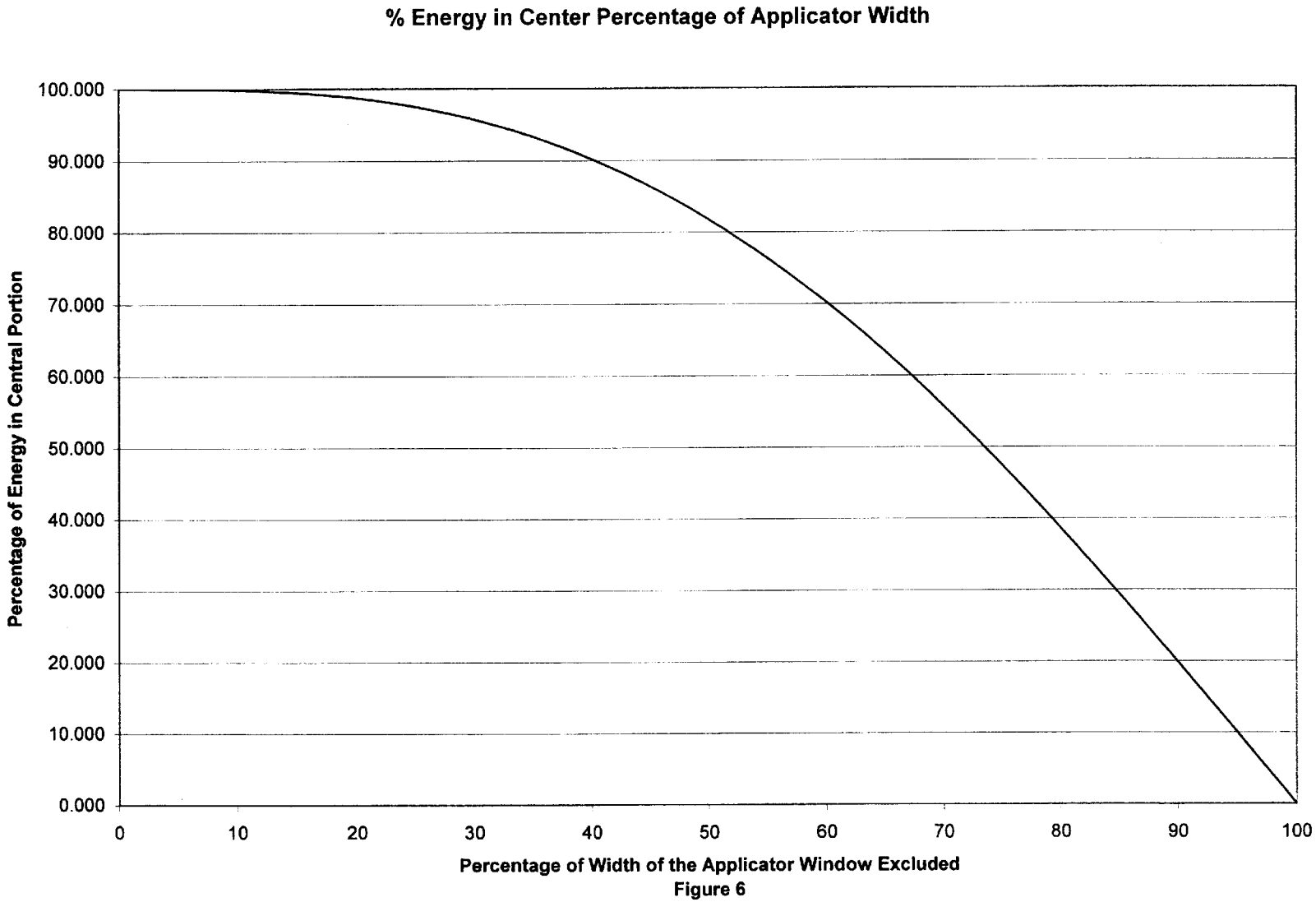
FIG. 6 is a graph of percentage of energy in the central portion as a function of the percentage of the width of the central portion of the application window on the layup when applying microwave energy in the $T_{10}$ rectangular mode thorough the window.

FIG. 6 shows the distribution of energy applied in the $T_{10}$ rectangular mode relative to the total width of the widow 38 or 44. It will be apparent that the maximum widths of the windows 38 and 44 are not critical and if desired the widow 38 and/or 44 could for example extend the fill width of the layup. It will be apparent that 90% of the energy is applied to heat the central portion C (see FIG. 4) of the layup 20 underlying the widow 38 or 44 and having a width $W_C$ that is about 60% of the width $W_W$ i.e. at least 20% of the width W at each side of the portion C contains only about 10% of he energy.

The minimum width of the windows is correlated with the width $W_C$ of a central portion C (see FIG. 4) that is to be heated by at least 90% of the microwave energy applied over no more than 80% of the width W of the layup 20.

While the $TE_{10}$ rectangular mode is preferred and the orientation of the electrical vectors of the microwave energy parallel with and preferably in the direction of travel is also preferred, it will be apparent that heating only the central portion i.e. the central 80% can be attained with modes other than the $TE_{10}$ mode and with other orientations of the electrical vectors e.g. the electrical vectors be transverse to or even perpendicular to the direction of travel of the elements into the press.

Because each of the windows 38 and 44 is significantly narrower (width $W_W$) than the width W of the layup 20, i.e. $W_W$ is less than W more specifically $W_W$ is typically less than 80% of W, the outsides of the layup receive little, if any, energy.

This distribution of energy applied to the preheater or preheating stage 22 is important. As the layup 20 passes into the press 24 and is compressed it is subjected to microwave energy as indicated by the arrows 56 and 58 which is introduced via a wave guides 60 and 62 in the direction substantially perpendicular to the direction of the microwave energy represented by the arrows 26 and 28, i.e. the wave guides 60 and 62 direct microwave energy across the width i.e. perpendicular to the axial center line 48 and parallel to the width direction which inherently means that majority of the energy applied to the layup in the press 24 via the wave guides 60 and 62 is concentrated adjacent to the side edges of the compressed layup. The energy added by the microwave energy 56 and 58 is sufficient to bring the temperature of the layup in particular the adhesive to curing temperature whereby the adhesive is cured in the press section 24 after the layup has been pressed to final thickness to form the consolidated product 64 (see FIG. 2) having a thickness $t_2$ significantly smaller than the incoming thickness of the layup $t_1$.

It will be apparent that the total energy applied in the preheating section 22 will not be sufficient to raise the temperature of the mat or layup 20 even in the central portion where the maximum energy is applied to a temperature that will cure the resin before the mat reaches the press.

Figure 5:
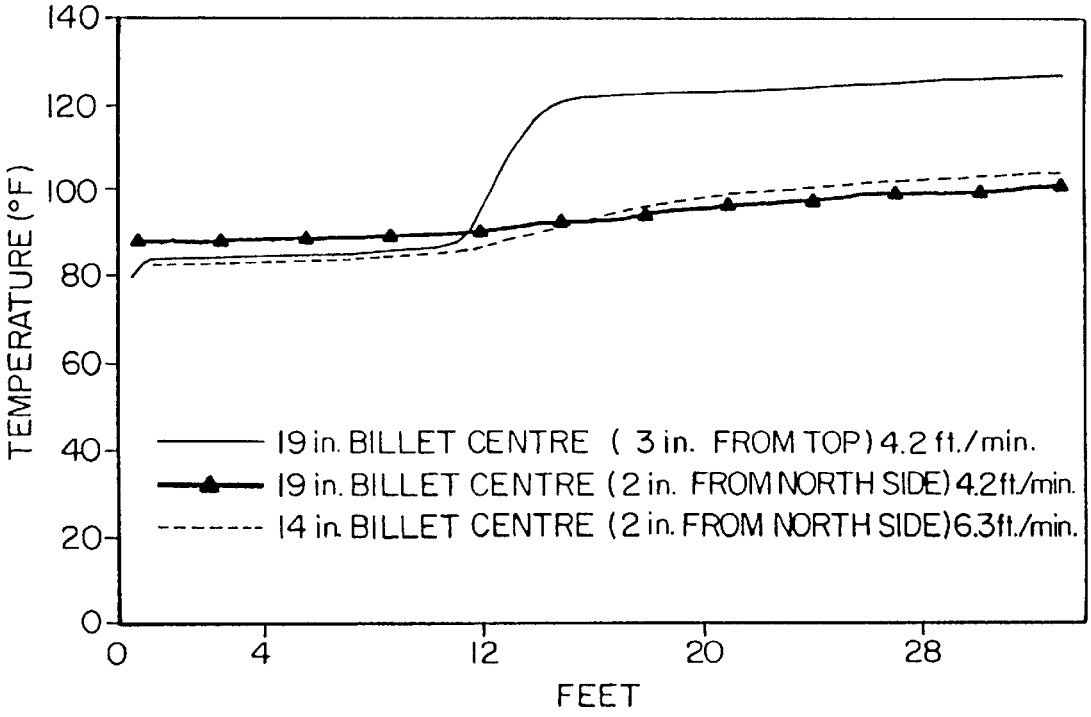
FIG. 5 is a graph of temperature versus distance showing the effect of the preheater on layup temperature at different locations in the layup.

Referring to FIG. 5, the curves shown in solid line is for a billet (incoming layup or mat 20) having a width of 19 inches and with the temperature probe position 3 inches from the top of the billet in the middle of the width W i.e. where the applied E field is maximum in the applicator 30.

The curve indicated by a solid line with triangular points shows the temperature sensed 2 inches from the north side in all of the 19 inch billet run (W=19 inches). The speed of the billet or layup was 4.2 feet a minute and the application of energy was 20 Kw in each of the top and bottom window (44 and 38) ($t_2$ was 11.5 inches).

The results for a 14 inch billet are indicated by the dot-dash curve in FIG. 5, the power application was 18 Kw at the top window 44 and 24 KW at the bottom window 38. The speed of the billet was 6.3 feet a minute. In this case, the temperature probe was positioned 2 inches from the north side of the billet.

It will be apparent that the effect of the preheater is not seen 2 inches from the north side of the billet for both 14 inch and 19 inch wide billets considering that the width of the two windows (superimposed one on the other) was 9¾ inches, i.e. 4⅜ inches on opposite sides of the axial centerline which for the 19 inch billet means the window terminated 4⅝ inches from the side yet the probe positioned 2 inches from the side shows very little change in temperature. The same was seen for the 14 inch billet where the edge of the window was 2⅛ inches from the side edge of the billet yet the probe positioned 2 inches from the sides of the billet i.e. ⅛ inch to the side of the windows showed no direct effect of the preheater.

The temperature 3 inches from the top of the billet in the middle of width W shows a significant increase in temperature from about 85° F. up to about 120° F. in a matter of movement of the billet of about 3 feet as the billet passed the windows and thereafter there is a relatively slow rise in temperature indicating some form of exothermic reaction is taking place, probably the absorption of water vapor created by the additional energy into the wood. Two advantageous results occur, first the center of the layup is at a higher temperature than the edge, and second conditioning is occurring at a higher rate because of this higher temperature To take advantage of this invention, it is necessary that the heat applied in the preheater be supplemented with heat from the side applicators 60 and 62, i.e. the energy inputs indicated at 56 and 58 must combine with the energy input at 26 and 28 to substantially uniformly heat the billet or layup to a temperature sufficient to develop resin cure. It has been found that the energy applied in the preheater should be between 2 and 100% preferably between 5 to 30% of the energy applied by the two wave guides 60 and 62 and that as above described, the energy applicator in the preheater should preferably be confined to less than 80% of the width of the layup or billet 20, preferably will be somewhere between 50 and 80% of the width of the billet, i.e. $W_W/W$ will equal 0.5 to 0.8. This ratio depends on the press width and the microwave penetration depth of the microwave power applied from the side applicators 60 and 62.

Having described the invention, modifications will be evident to those skilled in the art without departing from the scope of the invention as defined in the appended claims.

We claim:

1. A method of producing a consolidated composite wood product composed of wood elements and a binder having a setting temperature comprising forming a layup for such wood elements and binder, said layup having a width W measured substantially perpendicular to a longitudinal axis of said layup and a thickness $t_1$, moving said layup in a direction parallel to said longitudinal axis, applying a preheating microwave energy in a preheating stage through the thickness of said layup applying at least 90% of said microwave energy in a manner to heat a central portion of said layup, said central portion having a width $W_C$ no greater than 80% of the width W of said layup, reducing the thickness of said layup to a final thickness t2 in a press and applying microwave energy to set said binder in said layup in said press by directing microwave energy to pass through said layup in a direction substantially perpendicular to the direction of the application of said preheating microwave energy in said preheating stage to heat said layup to a temperature above said setting temperature of said binder whereby said binder sets after said layup has been pressed to its final thickness $t_2$ thereby to form said consolidated wood product.

2. A method of producing a consolidated composite wood product as defined in claim 1 wherein said application of said preheating microwave energy applies less energy than that required to raise the temperature in said layup up to said setting temperature of said binder.

3. A method of producing a consolidated composite wood product as defined in claim 2 wherein said preheat microwave energy applied in said preheating stage is in the $TE_{10}$ mode with the maximum energy being applied to said layup along its longitudinal axis and electrical vectors of said preheating microwave energy in the direction of movement of said layup into said press.

4. A method of producing a consolidated composite wood product as defined in claim 3 wherein said $TE_{10}$ mode is a $TE_{10}$ rectangular mode.

5. A method of producing a consolidated composite wood product as defined in claim 4 wherein said energy is applied in said preheating stage spaced from an entrance end of said press by a distance D sufficient to permit moisture heated by said microwave energy to distribute in said layup.

6. A method of producing a consolidated composite wood product as defined in claim 2 wherein said energy is applied in said preheating stage spaced from an entrance end of said press by a distance D sufficient to permit moisture heated by said microwave energy to distribute in said layup.

7. A method of producing a consolidated composite wood product as defined in claim 3 wherein said energy is applied in said preheating stage spaced from an entrance end of said press by a distance D sufficient to permit moisture heated by said microwave energy to distribute in said layup.

8. A method of producing a consolidated composite wood product as defined in claim 1 wherein said preheat microwave energy applied in said preheating stage is in the $TE_{10}$ mode with the maximum energy being applied to said layup along its longitudinal axis and electrical vectors of said preheating microwave energy in the direction of movement of said layup into said press.

9. A method of producing a consolidated composite wood product as defined in claim 8 wherein said $TE_{10}$ mode is a $TE_{10}$ rectangular mode.

10. A method of producing a consolidated composite wood product as defined in claim 9 wherein said energy is applied in said preheating stage spaced from an entrance end of said press by a distance D sufficient to permit moisture heated by said microwave energy to distribute in said layup.

11. A method of producing a consolidated composite wood product as defined in claim 8 wherein said energy is applied in said preheating stage spaced from an entrance end of said press by a distance D sufficient to permit moisture heated by said microwave energy to distribute in said layup.

12. A method of producing a consolidated composite wood product as defined in claim 1 wherein said energy is applied in said preheating stage spaced from an entrance end of said press by a distance D sufficient to permit moisture heated by said microwave energy to distribute in said layup.

* * * * *